US005134011A

United States Patent [19]

Kamiya et al.

[11] Patent Number: 5,134,011

[45] Date of Patent: Jul. 28, 1992

[54] FERRITIC STAINLESS STEEL COATED WITH A BLADE OXIDE AND ITS MANUFACTURING PROCESS

[75] Inventors: Takeshi Kamiya; Noboru Tachino, both of Kawasaki, Japan

[73] Assignee: Nippon Yakin Kogyo Co., Ltd., Tokyo, Japan

[21] Appl. No.: 509,305

[22] Filed: Apr. 16, 1990

[30] Foreign Application Priority Data

Apr. 17, 1989 [JP] Japan ..... 1-95386

[51] Int. Cl.[5] ..... B32B 3/12

[52] U.S. Cl. ..... 428/116; 427/377; 427/378; 427/399; 428/469; 428/472; 428/472.2; 428/688; 422/168; 502/245; 502/257; 502/527

[58] Field of Search ..... 428/469, 472, 688, 472.2, 428/116; 502/527, 245, 257, 313; 148/13.1, 20.3, 135; 427/399, 377, 378; 422/180, 179, 168, 177

[56] References Cited

U.S. PATENT DOCUMENTS

| | | | |
|---|---|---|---|
| 3,839,224 | 10/1974 | Yonehara et al. | 502/245 |
| 3,931,050 | 1/1976 | Asano et al. | 502/313 |
| 3,957,692 | 5/1976 | Cauns et al. | 502/527 |
| 4,189,404 | 2/1980 | Keith et al. | 502/527 |
| 4,247,422 | 1/1981 | Davies | 502/527 |
| 4,253,992 | 3/1981 | Soejima ewt al. | 502/527 |
| 4,331,631 | 5/1982 | Chapman et al. | 502/316 |
| 4,601,999 | 7/1986 | Retallick et al. | 502/257 |
| 4,749,671 | 6/1988 | Saito et al. | 502/245 |
| 4,784,984 | 11/1988 | Yamanaka et al. | 502/527 |

FOREIGN PATENT DOCUMENTS

| | | | |
|---|---|---|---|
| 318864 | 11/1988 | European Pat. Off. | 502/316 |

*Primary Examiner*—Ellis P. Robinson
*Assistant Examiner*—Archene A. Turner
*Attorney, Agent, or Firm*—Sherman and Shalloway

[57] ABSTRACT

A ferritic stainless steel, of which the surface is coated with a blade-like aluminum oxide, is disclosed. The ferritic stainless steel can be manufactured by heating a ferritic stainless steel containing aluminum at the surface in a stream of purified air. The aluminum-containing stainless steel possesses improved adhesiveness to catalyst carrier which can be utilized in a honeycomb metal structure for a catalytic converter for automobile exhaust gases or in a catalytic device for purifying combustion gases.

10 Claims, 2 Drawing Sheets

FERRITIC STAINLESS STEEL COATED WITH A BLADE OXIDE AND ITS MANUFACTURING PROCESS

BACKGROUND OF THE INVENTION

1. Field of the Invention

The present invention relates to a ferritic stainless steel with an aluminum-containing surface which is coated with a blade-like aluminum oxide and the process for manufacturing this stainless steel; and, in particular, to an aluminum-containing stainless steel with improved adhesiveness to catalyst carrier which can be utilized in a honeycomb metal structure for a catalytic converter for automobile exhaust gases or in a catalytic device for purifying combustion gases, and the process for manufacturing this stainless steel.

2. Description of the Prior Art

Conventionally, a honeycombed structure made from a stainless steel filament containing aluminum, with alumina whiskers formed on the surface in order to strengthen the adhesiveness to catalyst carrier, is used as a catalytic converter for automobile exhaust gases. Activated alumina particles are applied as a coating to this honeycombed structure as a catalyst carrier, after which a catalytic metal such as Pt, Rh, or the like is caused to adhere to this coating.

A method by which alumina whiskers can be formed on this surface have been disclosed in Japanese Patent Laid-open Nos. 96726/1981, 152965/1981, and 71898/1982. This technology involves a two-stage process whereby a stainless steel filament is heated for about one minute at 875° to 925° C. in a low oxygen atmosphere with an oxygen partial pressure of 0.75 Torr or less, after which it is subjected to long-term oxidation in air in a temperature range of 870° to 930° C. In addition, in Japanese Patent Laid-open No. 299711/1987 a process is disclosed by the inventors of the present invention whereby a ferrite stainless steel is coated with aluminum then heated under vacuum or in an atmosphere of non-oxidizing gases to diffuse the aluminum, after which it is subjected to long-term oxidation in air in a temperature range of 870° to 930° C.

However, the alumina whiskers on the surface of the stainless steel filament obtained by this type of process are formed and grow through a rather uncommon and unique oxidation process. Under the environment in which a catalytic converter for automobile exhaust gases is used in actual practice, this growth alumina whiskers continues, and the rate of growth is greater than the rate of growth of the more commonly known aluminum oxide protective layers. As a result, the adherence of the catalyst to this surface worsens, and, in addition, the high rate of growth of the alumina whiskers gives an adverse effect on its resistance to oxidation.

In order to improve the material with this type of drawback, the inventors of the present invention had previously proposed a method whereby once the alumina whiskers have been formed their further growth is restrained by a suitable heat treatment to a degree encountered in more common type of aluminum oxide protective layers (Japanese Patent Laid-open No. 166958/1988). However, with this method, after the alumina whiskers have once been formed on the surface by a heat treatment, they must be subjected to a second stage heat treatment at a temperature higher than 975° C.

SUMMARY OF THE INVENTION

An object of the present invention is to provide, with due consideration to the drawbacks of such conventional stainless steels and their manufacturing processes, a stainless steel with improved adhesiveness to catalyst carrier and a method for manufacturing such a stainless steel.

These objects are achieved in the present invention by the provision of a ferritic stainless steel, of which the surface is coated with a blade-like aluminum oxide, and by the provision of a process for manufacturing such a ferritic stainless steel, comprising heating a ferritic stainless steel containing aluminum at the surface in a stream of purified air.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE INVENTION AND PREFERRED EMBODIMENTS

Figure 1:
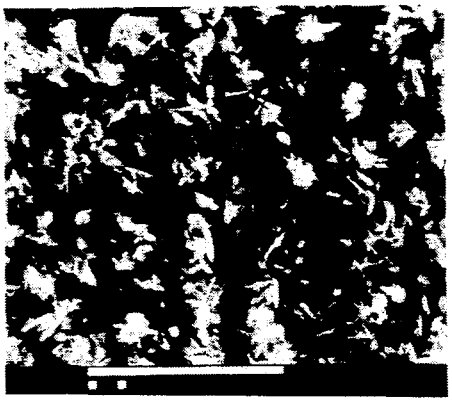
FIG. 1 is a photograph of a blade-like oxide taken with an electron microscope at 4,500 magnification.
Figure 4:
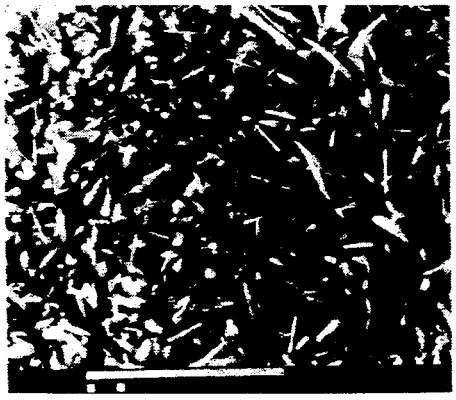
FIG. 4 is a photograph of a whisker-like oxide taken with an electron microscope at 4,500 magnification.
Figure 2:
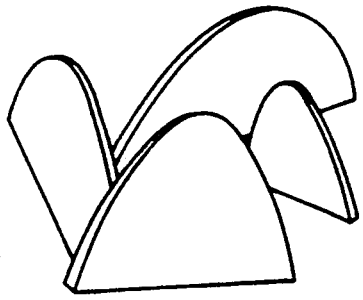
FIG. 2 is an illustrative view of the shape of the blade-like oxide.
Figure 5:
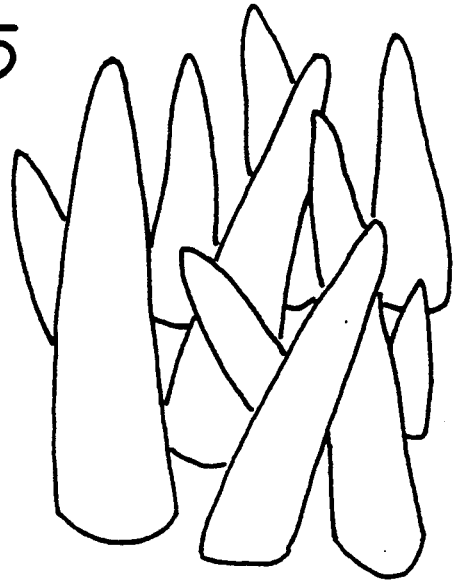
FIG. 5 is an illustrative view of the shape of the whisker-like oxide.

The present invention will now be explained in detail. The blade-like aluminum oxide of the present invention has a whisker length of about ¼ that of the conventional whisker-like aluminum oxide and is a half-moon shaped oxide with a width greater than the diameter of the conventional whisker-type. A photograph of a blade-like oxide and that of whisker-like oxide, both taken with an electron microscope at 4,500 magnification, are shown in FIG. 1 and FIG. 4. Illustrative views given in FIG. 2 and FIG. 5 clearly show the difference in the shapes of these oxides.

FIG. 1 is a photograph of a blade-like oxide taken with an electron microscope at 4,500 magnification.

This blade-like aluminum oxide is obtained by oxidizing a ferritic stainless steel containing aluminum at the surface under a stream of purified air. The purified air in this case can be air which is dried to remove most of its moisture content, and preferably air with a dew point of −30° C. or less.

Oxidation is carried out at a temperature in the 850° to 975° C. range.

Accordingly, the difference in formation conditions from the usual whisker-type oxide which is formed by oxidization in the atmosphere of the normal air after heating in a low-oxygen atmosphere is that an oxidizing atmosphere of purified air is used for the blade-type oxide.

Figure 3:
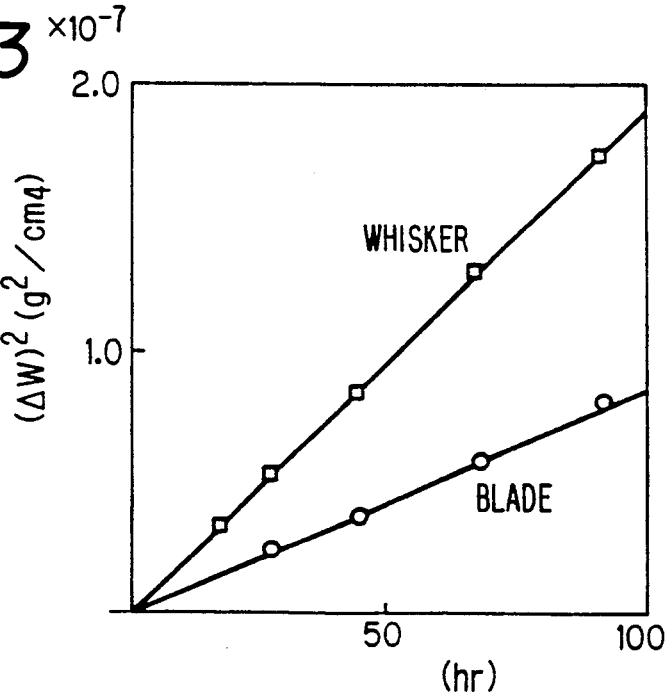
FIG. 3 shows the increase of oxidation in both the blade-like oxide of the present invention and a whisker-like oxide during a 900° C. continuous oxidation experiment.

When the blade-like oxide of the present invention is further heated at a high temperature, it acts differently than the whisker-like oxide inasmuch as the whiskers for the blade-like oxide grow both upward and laterally as the oxidation proceeds, while in the conventional whisker-like oxide the whiskers grow upward only. The rate of oxidation for the blade-like oxide is also much slower than for the whisker-like oxide. For this reason, when these oxides are used as a catalyst carrier the whisker-like oxide grows upward when subjected to heating and pushes the catalyst upward, which is detrimental to the adherence of the catalyst to the oxide. On the other hand, in the case of blade-like oxide the growth proceeds laterally as well as upward so that the detrimental effect encountered with the whisker-like oxide is avoided. In addition, as shown in FIG. 3, the rate of oxidation for the blade-like oxide is only about 50% of that of the whisker-like oxide, evidencing its superior resistance to oxidation.

Other features of the invention will become apparent in the course of the following description of the exemplary embodiments which are given for illustration of the invention and are not intended to be limiting thereto.

EXAMPLES

Example 1

A rolled plate of 20% Cr-5% Al rolled ferritic stainless steel was oxidized in an atmosphere of purified air. The capacity of the furnace used for oxidation was 20 liters and the stainless steel was oxidized in vacuo for 16 hours at 900° C. The purified air used was a mixture of 21% pure oxygen and 79% pure nitrogen, with a dew point of −70° C.

After oxidation, the surface of the ferritic stainless steel was photographed using a scanning electron microscope. On examination, the oxide was seen to be a blade-like oxide.

For purposes of comparison, a sample of the same 20% Cr-5% Al ferritic stainless steel was heated at 900° C. for 1 minute and oxidized under the same conditions as above except that the oxidation was carried out in an atmosphere of normal air rather than purified air. On examination of the surface of the stainless steel using the scanning electron microscope, the oxide was seen to be a whisker-like oxide. Next, both oxides were subjected to continuous oxidation in normal air at 900° C. and the increase in oxide was measured. The results are shown in FIG. 3. From these results it is seen that the growth rate of the blade-like oxide is slower that of the whisker-like oxide.

As outlined above, the adherence of the catalyst is increased by the blade-like oxide of the present invention, and, in addition, the rate of oxidation under subsequent oxidation conditions is extremely slow so that the catalyst the oxide possesses superior resistance to oxidation.

Obviously, numerous modifications and variations of the present invention are possible in light of the above teachings. It is therefore to be understood that within the scope of the appended claims, the invention may be practiced otherwise than as specifically described herein.

What is claimed is:

1. An aluminum containing ferritic stainless steel having on its surface aluminum oxide with a blade-like configuration as shown in FIG. 1.

2. A process for manufacturing a ferritic stainless steel, of which the surface is coated with a blade-like aluminum oxide configuration as shown in FIG. 1, comprising heating an aluminum containing ferritic stainless steel in a stream of purified air.

3. The process of claim 2, wherein said purified air is dried air having a dew point of about −30° C. or below.

4. The process of claim 2, wherein the aluminum containing ferritic stainless steel is heated to a temperature of about 850° to 975° C.

5. The aluminum oxide coated stainless steel of claim 1, wherein the steel contains chromium.

6. The aluminum oxide coated stainless steel of claim 1, wherein said aluminum oxide has a coating thereon of a catalyst.

7. The aluminum oxide coated stainless steel of claim 6, wherein the catalyst is platinum or rhodineum.

8. A catalytic converter having a honey-comb metal structure formed from an aluminum containing ferritic stainless steel, having on its surface aluminum oxide with a blade-like configuration as shown in FIG. 1.

9. The catalytic converter of claim 8, wherein said aluminum oxide has a coating thereon of a catalyst.

10. The catalytic converter of claim 9, wherein the catalyst is platinum or rhodineum.

* * * * *